United States Patent [19]

Yoshida et al.

[11] Patent Number: 4,739,370

[45] Date of Patent: Apr. 19, 1988

[54] CLEANING DEVICE

[75] Inventors: Nobutoshi Yoshida, Yokohama; Hisaaki Senba, Tokyo; Keishi Ohsawa, Kawasaki; Takashi Hino, Tokyo, all of Japan

[73] Assignee: Canon Kabushiki Kaisha, Tokyo, Japan

[21] Appl. No.: 671,681

[22] Filed: Nov. 15, 1984

[30] Foreign Application Priority Data

| | | | |
|---|---|---|---|
| Nov. 16, 1983 | [JP] | Japan | 58-214087 |
| Nov. 16, 1983 | [JP] | Japan | 58-214089 |
| Dec. 23, 1983 | [JP] | Japan | 58-242080 |

[51] Int. Cl.[4] ..... G03G 21/00

[52] U.S. Cl. ..... 355/15; 118/652; 430/125

[58] Field of Search ..... 355/15; 15/1.5 R, 256.5, 15/256.51, 256.52; 118/652; 430/125

[56] References Cited

U.S. PATENT DOCUMENTS

| | | | |
|---|---|---|---|
| 3,572,923 | 3/1971 | Fisher et al. | 355/15 |
| 3,838,472 | 10/1974 | Oriel | 15/256.51 |
| 4,066,017 | 1/1978 | Garcowski et al. | 15/256.5 |
| 4,181,425 | 1/1980 | Higaya et al. | 355/15 |
| 4,253,761 | 3/1981 | Takizawa et al. | 355/15 |
| 4,263,390 | 4/1981 | Yamashita et al. | 355/15 X |
| 4,279,501 | 7/1981 | Kojima et al. | 355/15 |
| 4,314,018 | 2/1982 | Matsumoto et al. | 355/15 X |
| 4,320,958 | 3/1982 | Fantuzzo | 355/15 X |
| 4,349,270 | 9/1982 | Wada et al. | 355/15 |
| 4,395,113 | 7/1983 | Buchan et al. | 15/256.52 X |
| 4,530,596 | 7/1985 | Kawamoto et al. | 355/15 |
| 4,533,235 | 8/1985 | Uchida | 355/15 |

FOREIGN PATENT DOCUMENTS

| | | | |
|---|---|---|---|
| 56-121070 | 9/1981 | Japan | 355/15 |
| 57-46278 | 3/1982 | Japan | 355/15 |
| 58-142375 | 8/1983 | Japan | 355/15 |
| 58-153980 | 9/1983 | Japan | 118/652 |
| 59-181377 | 10/1984 | Japan | 355/15 |

OTHER PUBLICATIONS

*Xerox Disclosure Journal*, vol. 2, No. 5, Sep./Oct. 1977, Hively, J., "Photoreceptor Scrubber", pp. 111–112.

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A cleaning device which ensures perfect cleaning of the surface of an image bearing member by a cleaning device for cleaning toner remaining on the surface of the image bearing member and a cleaning roller disposed upstream of the cleaning device with respect to the direction of movement of the image bearing member and rotatable while being in contact with the surface of the image bearing member, the cleaning roller having an elastic outer layer of high hardness and an elastic inner layer of lower hardness than the outer layer.

25 Claims, 3 Drawing Sheets

CLEANING DEVICE

BACKGROUND OF THE INVENTION

1. Field of the Invention

This invention relates to a cleaning device in an image forming apparatus utilizing the electrostatic photographic process.

2. Description of the Prior Art

In an image forming apparatus wherein a transferrable image by toner is electrostatically formed on the surface of an endlessly moving image bearing member and the transferrable image is transferred to a transfer material such as paper, whereafter toner remaining on the surface of the image bearing member and foreign materials such as minute paper pieces produced from the transfer paper and adhering to the surface of the image bearing member, rosin, talc, etc. precipitated from the transfer paper or corona products produced by a high voltage generating member in the image forming process are removed to make the image bearing member available for repetitive use, the provision of cleaning means for removing the above-mentioned residual toner and various foreign materials is a requisite condition for obtaining hard copies of good quality.

As the cleaning means for such purpose, there have heretofore been proposed various means using a fur brush, a cleaning blade, a web or the like, and these conventional cleaning means can remove the residual toner but is insufficient to remove the talc, rosin, etc. present in transfer paper pieces or the corona products based on the presence of a high voltage source, and if such materials adhere to the surface of the image bearing member, particularly in the case of high humidity, these substances absorb the moisture and the surface of the image bearing member becomes lower in resistance, and this had led to the undesirable possibility that the electrostatic latent image formed on the surface of the image bearing member is remarkably disturbed (the flow of the image) and the quality of the copy image is remarkably deteriorated. That is, if the electrical resistance on the surface of the image bearing member is low, the flow of the image becomes liable to occur.

To avoid such disadvantages, a device as shown, for example, in FIG. 1 of the accompanying drawings has already been proposed (Japanese Patent Application Laid-Open No. 104970/1982. This device will hereinafter be described briefly. A cleaning device C disposed in proximity to a cylindrical photosensitive medium rotatable in the direction of the arrow is provided with a cleaning blade for scraping off residual toner or the like, a magnetic roller M for catching and conveying the scraped-off toner, and a scraper S disposed in opposed relationship with the magnetic roller M. For example, by setting the spacing between the photosensitive medium 1 and the magnetic roller M to 0.8 mm and the spacing between the magnetic roller M and the scraper S to the order of 0.3 to 0.7 mm, a magnetic brush TB is formed on the surface of the magnetic roller on that side thereof which is more adjacent to the photosensitive medium than the scraper S, whereby the magnetic brush removes the residual toner or the like conveyed while adhering to the surface of the photosensitive medium 1. Such a device is effective to remove paper powder of 0.1 to 1 mm having a relatively weak adhesion force with respect to the photosensitive medium, but it has been difficult for such device to remove substances having a strong adhesion force such as rosin, talc and corona products.

Further, in order to avoid such a disadvantage, there has already been proposed cleaning means in which an elastic roller rotates while being in frictional contact with the surface of an image bearing member (U.S. Pat. No. 3,838,472 corresponding to Japanese Patent Application Laid-Open No. 100585/1980), but if a sponge roller is used, toner spills or scatters from the portion of frictional contact and causes clogging, which has unavoidably led to a deteriorated cleaning effect. Also, if the roller is too strongly urged against the image bearing member, residual toner is conversely pressed against the surface of the image bearing member to thereby form a portion of high resistance, which has led to the undesirable possibility that unnecessary developing action is effected to adversely affect the quality of image of hard copies. Further, if the roller is rotated while being in strong contact with the surface of the image bearing member, the required torque of the driving system is increased, and this has caused image blur. Also, if a roller of low hardness is used to alleviate the frictional action, the surface of the image bearing member is damaged because, for example, in the case of polyurethane rubber, an aging preventing agent is used, and in the case of silicone rubber, not only a roller of low hardness is difficult to manufacture, but also there has been the undesirable possibility that the residue of unreacted silicone oil or the like injures the surface of the image bearing member.

SUMMARY OF THE INVENTION

The present invention has been made in order to cope with the above-noted disadvantages peculiar to the prior art and an object thereof is to provide a cleaning device in which a double-layer roller having an inner layer of low hardness and an outer layer of high hardness is used as an elastic cleaning roller urged against the surface of an image bearing member and by utilization of the inner layer of low hardness, the outer layer of high hardness is urged against the image bearing member with a nip width to thereby sufficiently remove not only toner remaining on the surface of the image bearing member but also paper powder, talc, rosin, corona products, etc. having a strong adhesion force.

It is a further object of the present invention to provide a cleaning device in which a cleaning roller formed of an elastic material is disposed upstream of a cleaning member for the image bearing member and a thin toner layer is formed on the surface of the cleaning roller and the cleaning roller and the image bearing member have a relative speed therebetween, whereby the toner formed into the thin layer is sprinkled with paper powder, talc, rosin, corona products, etc. having a strong adhesion force on the image bearing member to thereby remove these substances with the thin toner layer by the cleaning roller.

DESCRIPTION OF THE PREFERRED EMBODIMENTS

Figure 1:
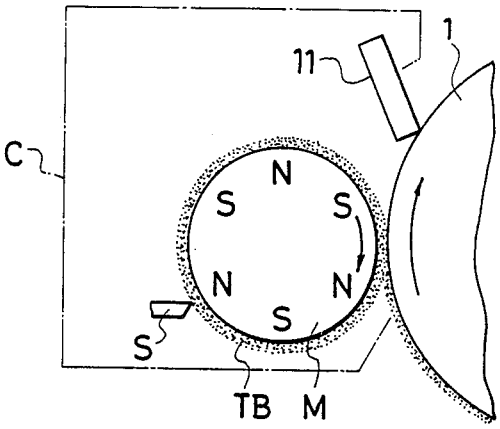
PRIOR ART FIG. 1
FIG. 1 is a cross-sectional view showing a cleaning device according to the prior art.
Figure 2:
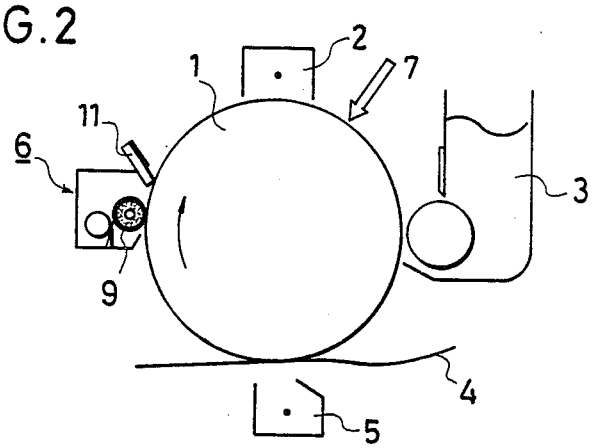
FIG. 2 is a cross-sectional view showing the construction of the essential portions of a copying apparatus to which the present invention is applied.

Referring to FIG. 2 which is a schematic side view showing essential portions of a cleaning device of the present invention applied to a copying apparatus, a photoconductive layer on a surface of a cylindrical photosensitive medium 1 rotatable in a direction of the arrow is uniformly charged by a charger 2 disposed near the photosensitive medium, whereafter an optical image 7 is applied to the surface of the photosensitive medium to thereby form an electrostatic latent image thereon, and the latent image is developed into a transferrable toner image by toner supplied by a developing device 3, and the toner image is transferred to a transfer material 4 such as paper supplied to a transfer station having a transfer charger 5 disposed near the surface of the photosensitive medium, whereafter the toner which has not contributed to the image transfer or other foreign materials are removed by the cleaning device 6 with the rotation of the photosensitive medium 1, and thus the surface of the photosensitive medium becomes ready for the next copying process.

Figure 3:
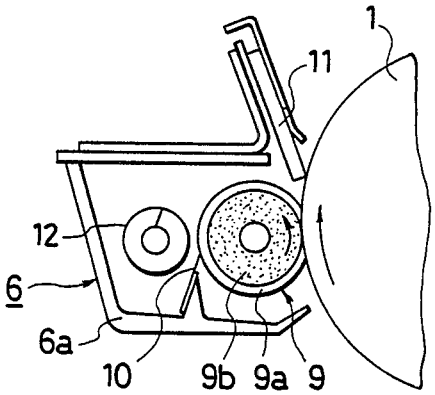
FIG. 3 is a cross-sectional view showing an embodiment of the present invention.
Figure 4:
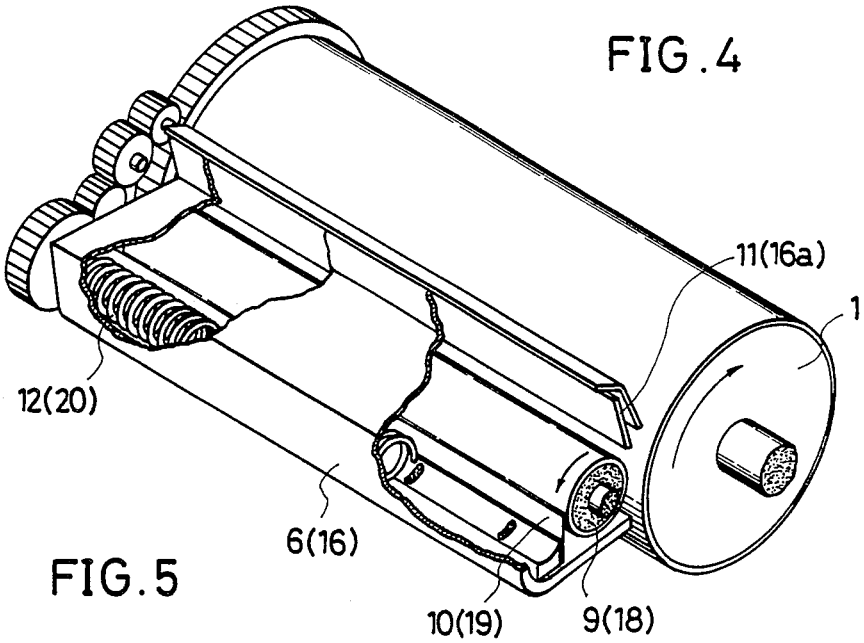
FIG. 4 is a perspective view thereof.

FIG. 3 is a side cross-sectional view illustrating the construction of the cleaning device 6 and FIG. 4 is a perspective view of the cleaning device. The cleaning device 6 is open at its side opposed to the photosensitive medium 1 and is provided with a housing 6*a* disposed substantially parallel thereto (in a direction perpendicular to the plane of the drawing sheet). A cleaning blade 11 formed of an elastic material such as polyurethane rubber is disposed at a suitable location on the open side of the cleaning device, and one free end edge thereof is urged against the surface of the photosensitive medium to scrape off any residual toner.

In the illustrated embodiment, an elastic cleaning roller 9 is disposed in the housing 6*a* upstream of the blade 11 with respect to the direction of rotation of the photosensitive medium and is designed to be frictionally rotated relative to the photosensitive medium at a relative speed by a suitable driving system (not shown). In this embodiment, the inner layer 9*b* of the cleaning roller 9 is formed of silicone sponge of low hardness and the outer layer 9*a* of the cleaning roller 9 is formed of a solid layer of stable silicone rubber of high hardness, and the cleaning roller as a whole is rich in elasticity and has a great nip width, with the outer layer 9*a* being urged against the surface of the photosensitive medium 1. The cleaning roller 9 frictionally rotates relative to the surface of the photosensitive medium at a relative speed to thereby remove any toner, paper powder, corona products, etc. remaining on the surface of the photosensitive medium.

With the rotation of the cleaning roller 9, the thus removed residual toner, etc. are conveyed with the toner or the like scraped off by the cleaning blade 11, and are brought to a reservoir in the housing by a scraper 10 and discharged out of the housing by a screw conveyor 12.

According to experiment, there was obtained a good result by using 20–40 degrees (ASKER C constant load 500 g) as the hardness of the cleaning roller, adopting a nip width of 1 to 6 mm when the cleaning roller is urged against the surface of the photosensitive medium, and making the speed of the cleaning roller relative to the speed of the photosensitive medium into 50 to 300%. The direction of rotation of the cleaning roller is not limited to the direction indicated in FIG. 3, but may also be opposite thereto.

Foreign materials such as paper powder and corona products adhering to the surface of the photosensitive medium 1 with the residual toner are effectively removed by the elastic cleaning roller 9 frictionally rotated relative to the photosensitive medium, and at this time, clogging or the like does not occur because the surface of the roller 9 is solid, and the use of silicone rubber of great hardness eliminates the undesirable possibility that any unreacted substance in the rubber adversely affects the photoconductive layer of the photosensitive medium. Also, the cleaning roller has a soft inner layer therein and therefore, even if the cleaning roller is urged against the photosensitive medium, the undesirable possibility that it imparts an overload to the driving system or causes image blur can be prevented.

Also, foreign materials such as paper powder on the surface of the photosensitive medium are removed mainly by the cleaning roller 9 and thus, the cleaning blade 11 downstream of the cleaning roller may deal with only the toner and therefore, the end edge of the blade is not damaged by the various foreign materials or conversely the foreign materials do not rub the surface of the photosensitive medium, with a result that the durability of the cleaning blade is increased.

The toner and other foreign materials removed by the cleaning roller 9 and the cleaning blade 11 are conveyed inwardly of the housing 6*a* with the rotation of the roller, are scraped off by the scraper 10 and come to the toner reservoir and, if required, they may be discharged out of the housing by the screw conveyor 12.

In the illustrated embodiment, silicone sponge is used for the inner layer of the cleaning roller, but use may also be made of polyurethane rubber, chloroprene rubber, butyl rubber, EPDM or the like, and as the outer layer, instead of silicone rubber, use may be made of tubularly shaped polyurethane rubber, CR or the like not mixed with an additive such as an aging preventing agent, polyethylene, polyester or ethylene polyfluoride to reduce the cost. What is important is to make the inner layer of an elastic material of lower hardness than the other layer.

Also, by making both the outer layer of the cleaning roller and the scraper 10 of an insulating material and charging the surface of the cleaning roller by the frictional charging resulting from the contact between the cleaning roller and scraper to thereby electrostatically collect the toner, paper powder and other foreign materials, the scattering of the toner, etc. and resultant contamination of the interior and exterior of the apparatus can be prevented.

Figure 5:
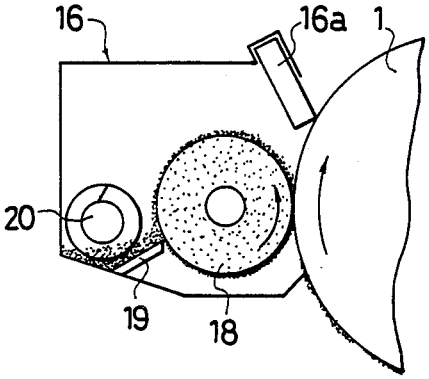
FIGS. 5 to 7 are cross-sectional views showing further embodiments of the present invention.

Another embodiment of the present invention will now be described by reference to FIG. 5. FIG. 5 is a cross-sectional view of the cleaning device according to the present embodiment, and a perspective view thereof is similar to FIG. 4. It is to be understood that the residual toner and various foreign materials adhering to the surface of the photosensitive medium 1 are removed at the position of the cleaning device by a cleaning roller 18 contained in the device and formed of an insulative elastic material and urged against the photosensitive medium. The cleaning roller 18 may preferably be designed to be rotated in the direction of the arrow or in the opposite direction and to have a peripheral speed relative to the surface of the photosensitive medium.

The toner and other foreign materials removed by the cleaning roller 18 and the toner scraped off by a cleaning blade 16a downstream of the cleaning roller are conveyed onto the surface of the roller 18 and then to a toner reservoir in the housing with the rotation of the roller 18 and may be discharged out of the device by a screw conveyor 20 as required.

A scraper 19 being in contact with the cleaning roller 18 and formed of an insulating material is disposed at a suitable location in the housing and guides the waste toner and other foreign materials conveyed on the cleaning roller to the toner reservoir in the housing and also causes frictional charging by the pressure contact between the scraper 19 and the insulative cleaning roller 18. It is to be understood that the polarity of the charge created at this time is determined so as to be opposite to the polarity of the toner. For example, by using silicone rubber for the cleaning roller 18 and using methyl methacrylate Mylar for the scraper 19, the roller 18 can be rendered into the negative polarity and actually, the surface potential of the roller 18 is −700 to −1500 V and it is possible to sufficiently electrically hold the toner on the surface of the roller.

Also, by using silicone rubber for the cleaning roller 18 and using Teflon (trade name, Dupont, Inc.) or polyethylene for the scraper 19, the surface of the roller 18 can be charged to the positive polarity.

It is difficult for the toner adhering to the cleaning roller 18 to be removed from the roller due to the electrical catching action as described above and therefore, even if the toner conveyed is scraped by the scraper 19, not all of the toner is removed, but even downstream of the scraper 19 with respect to the direction of rotation of the cleaning roller 18, the toner comes to the position at which the cleaning roller is urged against the photosensitive medium in a state in which a thin toner film of the order of 50 to 100$\mu$ is formed on the surface of the roller.

As previously described, due to the presence of the surface potential of the cleaning roller 18, the foreign materials such as paper powder readily shifts to the cleaning roller side with the toner.

Also, the cleaning roller 18 is urged against the photosensitive medium to form a nip of a suitable width (which may usually be of the order of 2 mm) and effect friction sufficiently and therefore, foreign materials having a relatively strong adhesion force, such as rosin and talc precipitated from paper powder or corona products can also be reliably removed.

In this case, as described hereinbefore, a thin film chiefly of toner from which foreign materials have been removed by the scraper 19 is formed on the surface of the cleaning roller 18 and this film achieves a lubricating action, whereby even if the cleaning roller 18 is urged against the photosensitive medium, the latter will not be damaged and frictional charging can be prevented.

Further, paper powder and other foreign materials are not present in the residual toner which arrives at the cleaning blade 16a and therefore, at this position, the photosensitive medium is not injured.

Figure 6:
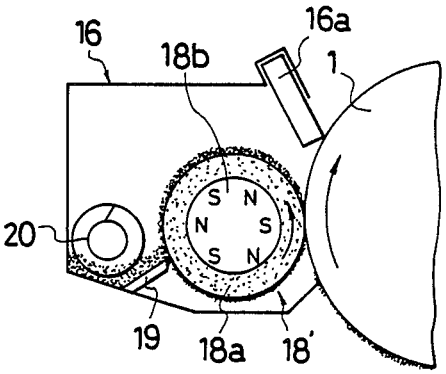

FIG. 6 shows still another embodiment of the present invention. In FIG. 6, portions corresponding to the portions shown in FIG. 5 are given similar reference characters and those portions are similar in construction to the portions of FIG. 5 and need not be described.

In this embodiment, a magnetic roller 18b having magnetic poles alternately disposed on the circumference thereof is contained in an elastic roller 18a formed of an insulating material, to thereby form a cleaning roller 18', whereby during the rotation of this roller, the frictional conveying action of the toner, etc. by the presence of the magnetic roller 18b is expedited.

Figure 7:
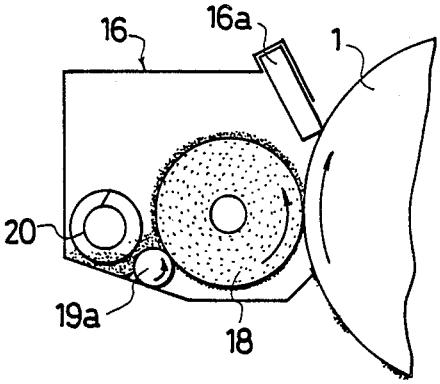

FIG. 7 shows still another embodiment of the present invention. In FIG. 7, portions corresponding to the portions of each of the above-described embodiments are given similar reference characters. In this embodiment, instead of the scraper, a roller 19a of the same material as the scraper is adapted to be urged against the cleaning roller 18, and is in the case of the scraper, it will be readily understood that the guide of the waste toner, the formation of toner coating on the cleaning roller and the generation of the frictional charging action can be ensured.

In the above-described embodiments, the direction of rotation of the cleaning roller is shown as opposite to the direction of rotation of the photosensitive medium 1, but the directional rotation of the former may be the same as the that of latter to obtain a similar effect, and design may preferably be made such that there is a relative speed of the order of 50–300% between the photosensitive medium and the cleaning roller at the location whereat these two are urged against each other.

When a paper supply experiment was carried out by the use of the cleaning device as shown in FIG. 5, no damage and no disturbance of electrostatic latent image resulting from the reduction in surface resistance occurred on the surface of the photosensitive medium, and copies of good quality could be obtained even after 10,000 sheets of paper were supplied. In contrast, with the device of FIG. 7, deterioration of the quality of image resulting from the disturbance of the electrostatic latent image was found after the supply of several thousand sheets of paper.

When an experiment was carried out by the use of a device in which no thin toner film was formed on the cleaning roller, damage of several $\mu$m occurred to the surface of the photosensitive medium after the supply of several thousand sheets of paper and further, the deterioration of the quality of image resulting from the frictional charging between the cleaning roller and the photosensitive medium occurred.

When a similar experiment was carried out by the use of a cleaning roller charged to the same polarity as that of toner, the toner coating formed on the roller was non-uniform and charging irregularity and injury occurred to the photosensitive medium and moreover, the shift of toner at the portion of contact between the photosensitive medium and the cleaning roller did not take place sufficiently and paper powder and other foreign materials passed this portion, with a result that as in the case of the conventional device, disturbance of electrostatic latent image occurred and deterioration of the quality of image was brought about after the supply of several thousand sheets of paper and further, much toner spilt or scattered.

An experimental example of the sliding friction effect in the cleaning device according to the embodiment of FIG. 5 will now be shown and described. This device is such that the foreign materials (rosin, talc, etc.) adhering to the drum are sprinkled with a thin toner layer formed on the surface of the cleaning roller by the nip between the cleaning roller and the drum and are removed thereby and therefore, if the thickness of the toner layer (the thickness of the toner layer on the surface of the cleaning roller controlled by the scraper) is too great, the foreign materials adhering to the drum which have been sprinkled with the toner are not sufficiently removed from the surface of the cleaning roller by the scraper, but are again carried to the nip portion (that is, the rate at which the toner is scraped becomes smaller and the replacement thereof with contaminated toner also becomes worse) and it becomes difficult to remove new foreign materials adhering to the drum. Accordingly, the efficiency of removing the foreign materials adhering to the drum is reduced and the surface resistance of the drum becomes smaller due to the presence of rosin, talc, etc. which are the foreign materials adhering to the drum. As a result, the image is likely to smear.

Also, if the toner layer on the surface of the cleaning roller is absent or thin, it will become impossible to well sprinkle the foreign materials adhering to the drum with the toner and thus, it will become impossible to effectively remove those foreign materials.

That is, as described above, the thickness of the toner layer on the surface of the cleaning roller affects the removal of the drum-adhering materials by the friction at the nip portion between the cleaning roller and the photosensitive drum, and the surface resistance (Ω.cm) of the drum by the drum-adhering materials is varied with a result that the flow of the image is affected.

Figure 8:
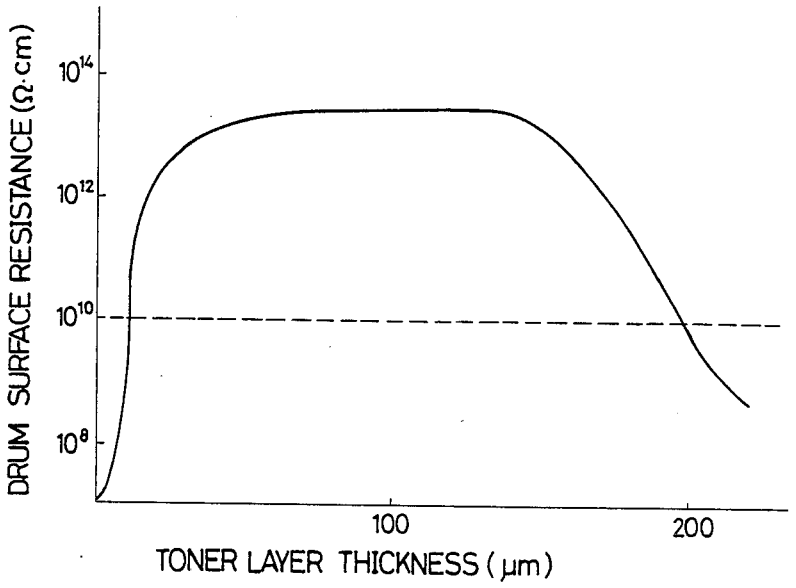
FIG. 8 is a graph showing the relation between the layer thickness and the drum surface resistance.

Such a relation between the thickness of the toner layer on the surface of the cleaning roller and the surface resistance of the drum is shown in FIG. 8. This is result of the experiment carried out under the following conditions: the photosensitive drum was an OPC photosensitive drum, the width of the nip between the photosensitive drum and the cleaning roller was 2 (mm), the pressure force of the two was 50 (g/mm), the rotational peripheral speed of the drum was 100 (mm/s), the rotational peripheral speed of the cleaning roller was 140 (mm/s), the relative speed thereof was 40 (mm/s), the nip passage time was 2/100 S, the degree of surface roughness of the cleaning roller was 7 (μm), the environmental conditions were 32° C. and 90% RH, the outer layer of the cleaning roller was Silicone solid rubber, the inner layer of the cleaning roller was Silicone sponge rubber, and the total hardness was 34° (JISA). That is, if the drum surface resistance indicated by a broken line in FIG. 8 is below $10^9$-$10^{10}$ (Ω.cm), the resistance is too low and the flow of the image becomes liable to occur and therefore, it will be understood that the flow of the image does not occur for the toner layer thickness of 10–200 μm. Preferably, the toner layer thickness may be in the range of 20–150 μm.

Description will now be made of the fact that the hardness of the cleaning roller (in case of two layers, the total hardness) also affects the frictional effect. That is, if the hardness of the cleaning roller is high, it will become difficult to secure the width of the nip between the cleaning roller and the photosensitive drum, and the area of friction between the toner and the drum-adhering materials at the nip portion will become smaller and the effect of sprinkling the drum-adhering materials with the toner will become weaker. If the hardness of the cleaning roller is too low, the scraper will thrust at the cleaning roller to damage the cleaning roller itself. As described above, the hardness of the cleaning roller affects the width of the nip between it and the photosensitive drum and as a result, affects the area of friction with the toner and affects the amount of drum-adhering materials sprinkled with and removed by the toner. According to the experiment, the intended purpose could be sufficiently achieved by the range of 20°–50° (JISA). However, preferably, the range of 25°–40° (JISA) may result in the best nip width and the best pressure force.

Description will further be made of the influence of the degree of surface roughness of the cleaning roller upon the friction effect. If the surface of the cleaning roller is rough, the thickness of the toner layer adhering to that surface will be non-uniform, and the amount of drum-adhering materials removed from the cleaning roller by the scraper differs depending on the thickness of the toner layer and therefore, removal of the drum-adhering materials becomes non-uniform on the surface of the cleaning roller and thus, removal of the drum-adhering materials at the nip portion also becomes non-uniform.

If the degree of surface roughness of the cleaning roller is too fine, the toner layer on the cleaning roller will be almost removed by the scraper. As described above, the degree of surface roughness of the cleaning roller affects the uniformity of the thickness of the toner layer formed on the surface of the cleaning roller and as a result, makes the removal of the drum-adhering materials non-uniform and thus affects the uniformity of the cleaning effect. According to the experiment, the intended purpose could be sufficiently achieved in the range of 2–20 μm RZ by the roughness of average ten points, but the range of 3–10 μm RZ is most preferable.

Finally, where the thickness of the toner layer on the surface of the cleaning roller is constant, the friction effect is considered to affect the friction force at the nip portion between the cleaning roller and the photosensitive drum, and when the width of the nip between the cleaning roller and the photosensitive drum is d and their relative speed is Δv and their pressure force is p, the friction force is considered to be proportional to the pressure force p of the photosensitive drum and the cleaning roller and the amount of relative movement Δl at the time t whereat the drum-adhering materials pass the width d of the nip.

That is, the friction force $$\alpha p \times \Delta l \quad (1)$$

The amount of relative movement Δl is the relative speed Δv multiplied by the nip passing time t and therefore, $$\Delta l = \Delta v \cdot t \quad (2).$$

Also, when the drum surface speed (the process speed) is vd, the nip passing time t is $$t = d/vd \quad (3).$$

Accordingly, from formulas (1), (2) and (3),

Friction force $\alpha p \times \Delta v \times t = p \times \Delta v \times d/vd$.

The friction force is good if it is greater than a certain value, but if it is too great, the surface of the photosensitive drum will be worn out.

Figure 9:
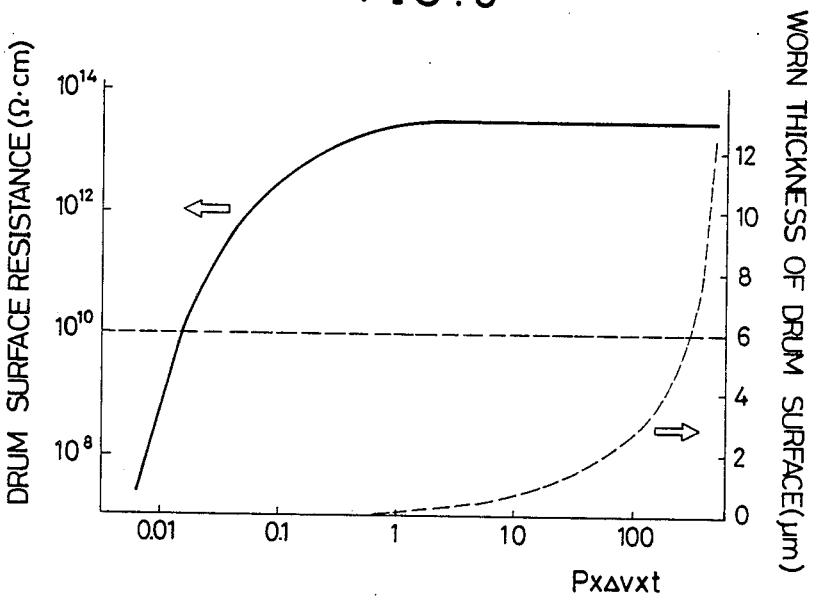
FIG. 9 is a graph showing the relation between the drum surface resistance and the friction effect.

FIG. 9 shows the case of an OPC photosensitive drum. In an amorphous silicon (a-Si) photosensitive medium, the worn thickness of the drum surface is small, but the drum surface resistance which affects the image is almost coincident with the amount shown in this graph. The other conditions were as follows: the outer layer of the cleaning roller was Silicone solid rubber, the inner layer of the cleaning roller was Silicone sponge rubber, the total hardness was 34° (JISA), the degree of surface roughness of the cleaning roller was 7 (μm), the pressure force p was 15–150 g/mm, Δv was 0.5–75 mm/s, and t was in the range of 0.5/100–6/100 s. The surface resistance of the photosensitive drum in FIG. 9 is a value obtained at a high temperature (32° C.) and high humidity (relative humidity of 90%) and after the supply of 10,000 sheets of A4 size paper. The worn thickness of the drum surface is the difference from the initial thickness under similar conditions. It will be seen that in order that the surface resistance of the photosensitive drum may be $10^{10}$ Ω.cm or more, the value of p.Δv.t may be about 0.025 or more. However, if the value of p.Δv.t exceeds 500, the worn thickness of the drum surface will be sharply increased and this is not preferable.

The result shown in the experiment of FIG. 9 is that obtained when the conditions p, Δv and t were in predetermined ranges, but the intended purpose can be achieved if the individual conditions are in the following ranges. The width of the nip between the photosensitive drum and the cleaning roller is 0.5–6 (mm), and 1–3 (mm) is the most preferable range when the worn thicknesses of the drum and roller are taken into account in terms of the dimensional accuracy, etc. of the photosensitive drum, etc. Also, the relative speed $$\frac{|vd - vr|}{vd} \times 100\ (\%)$$

of the photosensitive drum and the cleaning roller is 5–300 (%), and 20–100 (%) is the most preferable range when the sprinkled state of the toner, the worn thicknesses of the drum and roller, etc. are taken into account. Further, the pressure force of the photosensitive drum and the cleaning roller is 15–150 (g.cm), and it has been found that 20–100 (g/cm) is the most preferable range when the sprinkled state of the toner, the worn thicknesses of the drum and roller, etc. are taken into account.

What is claimed is:

1. A cleaning device for removing adhering materials including residual toner remaining on a surface of an image bearing member, comprising:

an elastic cleaning roller having an internal sponge rubber layer and an outer surface formed of a layer of solid rubber, said cleaning roller being disposed to press contact the surface of the image bearing member so as to be elastically deformed and thereby form a press-contact area against the image bearing member, said outer surface of said cleaning roller frictionally sliding on the surface of the image bearing member in the same direction as the image bearing surface and at a speed different from that of the the image bearing member surface at said press-contact area; and a cleaning blade for contacting and cleaning the image bearing member surface with pressure at a cleaning portion thereof downstream of said press-contact area of said elastic cleaning roller with respect to the movement direction of the image bearing member surface, said cleaning blade being effective to remove principally residual toner from the surface of the image bearing member.

2. A cleaning device according to claim 1, wherein said elastic cleaning roller contacts an image bearing member having one of an amorphous silicon layer and an organic, photosensitive layer.

3. A cleaning device according to claim 1, further comprising a scraping-coating member disposed adjacent to said outer surface of said elastic cleaning roller, said scraping-coating member separating most of the removed, adhering materials from said outer surface of said cleaning roller and uniformly forming on said outer surface a layer mainly composed of removed toner particles wherein said cleaning roller conveys said uniformly formed layer to said press-contact area.

4. A cleaning device according to claim 3, wherein said solid rubber layer has an average surface roughness Rz between 2 μm and 20 μm.

5. A cleaning device according to claim 4, wherein said solid rubber layer has an average surface roughness Rz between 3 μm and 10 μm.

6. A cleaning device according to claim 4, wherein said solid rubber layer is frictionally charged in a polarity opposite to a polarity of the residual toner.

7. A cleaning device according to claim 3, wherein said cleaning portion of said cleaning blade is located above said press-contact area, and said removed, adhering materials are conveyed over a path formed by said press-contact area, the outer surface of said cleaning roller and the area where said scraping-coating member is adjacent to said cleaning roller.

8. A cleaning device for removing adhering materials including residual toner remaining on a surface of an image bearing member, comprising:

an elastic cleaning roller having an outer surface formed of a layer of solid rubber, said cleaning roller being disposed to press-contact the surface of the image bearing member so as to be elastically deformed and thereby form a press-contact area against the image bearing member, said outer surface of said cleaning roller moving in the same direction as the image bearing member surface at said press-contact area;

a cleaning blade contacting the image bearing member at a cleaning portion thereof downstream of said press-contact area of said cleaning roller with respect to the movement direction of the image bearing member surface and removing the adhering materials mainly composed of toner from the image bearing member surface after passage though the press-contact area; and a member disposed adjacent to said cleaning roller, said member guiding the adhering materials removed from the image bearing member from said cleaning roller while maintaining a uniform coating layer formed mainly of the removed toner on said cleaning roller surface, said layer having an average thickness between 10 μm and 200 μm;

wherein the image bearing member is cleaned by said cleaning blade after the image bearing member is frictionally slid past said press-contact area against a press contact force by said elastic cleaning roller having said coating layer thereon.

9. A cleaning device according to claim 8, wherein said rubber outer surface moves at a speed different from that of the image bearing member surface at the press-contact area such that said coating layer increases a degree of friction upon the sliding against the image bearing member, said coating layer having a predetermined thickness between 20 μm and 150 μm.

10. A cleaning device according to claim 8, wherein said solid rubber layer has a surface roughness of less than 20 μm, and wherein said roller has an internal rubber layer of lower hardness than said outer rubber layer.

11. A cleaning device according to claim 8, wherein the toner is magnetic and said elastic roller has a magnet having a magnetic field generating portion at a central part of said roller.

12. A cleaning device according to claim 8, wherein said elastic roller is press-contacted against the image bearing member with a force between 15 g/cm and 150 g/cm.

13. A cleaning device according to claim 12, wherein said press-contact force is between 20 g/cm and 100 g/cm.

14. A cleaning device according to claim 8, wherein a length of said press-contact area in a direction of the movement of the image bearing member is between 0.5 μm and 6 mm.

15. A cleaning device according to claim 14, wherein said length of said press-contact area is between 1 mm and 3 mm.

16. A cleaning device for removing adhering materials including residual toner from a surface of an image bearing member, comprising:

an elastic cleaning roller having an internal sponge rubber layer and an outer surface formed of a layer of solid rubber, said cleaning roller being disposed to press-contact the surface of the image bearing member so as to be elastically deformed and thereby form a press-contact area against the image bearing member, wherein said surface of said cleaning roller frictionally slides on the image bearing member surface in the same direction as the image bearing member surface and at a speed different from that of the image bearing member surface at said press-contact area, said cleaning roller being pressed against the image bearing member with a predetermined pressure between 15 g/cm and 150 g/cm, said solid rubber outer surface layer having an average roughness of less than 20 μm;

a cleaning blade contacting the image bearing member at a cleaning portion thereof downstream of said press-contact area of said cleaning roller with respect to the movement direction of the image bearing member surface and removing the adhering materials composed of toner from the image bearing member surface after it passes through said press-contact area; and a member disposed adjacent to said cleaning roller, said member guiding the adhering materials removed from the image bearing member away from said cleaning roller while maintaining a uniform coating layer formed mainly of the removed toner on said cleaning roller surface, said layer having in an average thickness between 10 μm and 200 μm;

wherein the image bearing member is cleaned by said cleaning blade after the image bearing member is frictionally slid past said press-contact area against a press-contact force by said elastic cleaning roller having said coating layer thereon.

17. A cleaning device according to claim 16, wherein said cleaning roller press-contacts a photosensitive image bearing member having an organic photosensitive layer, said solid rubber layer has a surface roughness of less than 10 μm, and the thickness of said coating layer is between 20 μm and 150 μm.

18. A cleaning device according to claim 17, wherein said cleaning portion of said cleaning blade is located above said press-contact area, said removed, adhering materials are conveyed over a path formed by said press-contact area, the outer surface of said cleaning roller and the area where the member is adjacent to said cleaning roller, and said cleaning blade effects counter edge cleaning with the cleaning portion thereof.

19. A cleaning device for removing adhering materials including residual toner remaining on a surface of an image bearing member, comprising:

an elastic cleaning roller having an outer surface formed of a layer of solid rubber, said cleaning roller being disposed to press-contact the surface of the image bearing member with a line pressure of predetermined value P between 15 g/cm and 150 g/cm so as to be elastically deformed and thereby form a press-contact area against the image bearing member, said outer surface of said cleaning roller moving in the same direction as the image bearing member surface and at a speed difference Δv cm/sec. from the image bearing member surface at said press-contact area;

a regulating member disposed close to the outer surface of said cleaning roller to form a uniform coating layer mainly composed of toner on said solid rubber layer of a thickness d μm; and a cleaning blade contacting the image bearing member at a cleaning portion thereof downstream of said press-contact area of said cleaning roller with respect to the movement direction of the image bearing member surface and removing the adhering materials composed mainly of the toner from the image bearing member surface after it passes through the press-contact area;

wherein a product $P \times \Delta V \times T$, where t is a press-contact time in seconds between said cleaning roller and the image bearing member at said press-contact area, satisfies the following relation:

$0.025 \leqq P \times \Delta V \times t < 500$.

20. A cleaning device according to claim 19, wherein said cleaning portion of said cleaning blade is located above said press-contact area, and said removed, adhering materials are conveyed over a path formed by said press-contact portion, said outer surface of said cleaning roller and the area where said regulating member is close to said cleaning roller.

21. A cleaning device according to claim 19, wherein said cleaning roller contacts an image bearing member having an amorphous silicon layer, the surface resistance of which is more than $10^{10}$ Ω.cm inclusive.

22. A cleaning device according to claim 19, wherein said regulating member regulates said thickness d to a predetermined thickness between 10 μm and 200 μm.

23. A cleaning device according to claim 19, wherein said solid rubber layer has an average roughness between 2 μm and 20 μm.

24. A cleaning device according to claim 23, wherein said solid rubber layer has an average roughness of less than 10 μm inclusive.

25. A cleaning device for removing adhesive materials remaining on a surface of an image bearing member having a layer of one of an organic semiconductor and an amorphous silicon after a transfer process, comprising:

means for removing adhering materials excluding toner in said adhering materials remaining on the image bearing member, said removing means including an elastic roller having an outer surface formed of a layer of solid rubber with an average surface roughness of less than 20 μm disposed to press-contact the image bearing member so as to be elastically deformed and thereby form a press-contact area, said elastic roller rotating in the same direction as the image bearing member and at a surface speed different from that of the image bearing member surface at the press-contact area; and a regulating member disposed adjacent to the outer surface of said elastic roller in order to provide a coating layer formed mainly of toner particles and of a thickness between 10 μm and 200 μm between said elastic roller and the image bearing member; and a cleaning blade for contacting and cleaning the image bearing member surface with pressure at a cleaning portion thereof downstream of said press-contact area of said elastic cleaning roller with respect to the movement direction of the image bearing member surface, said cleaning blade being effective to remove principally residual toner from the image bearing member surface;

wherein said removing means and said cleaning blade are formed of materials such that a surface resistance of said image bearing member is maintained at more than $10^{10}$ Ω.cm.

* * * * *

UNITED STATES PATENT AND TRADEMARK OFFICE

CERTIFICATE OF CORRECTION

PATENT NO. : 4,739,370

DATED : April 19, 1988

INVENTOR(S) : NOBUTOSHI YOSHIDA, ET AL.

It is certified that error appears in the above-identified patent and that said Letters Patent is hereby corrected as shown below:

COLUMN 1

Line 47, "104970/1982." should read --104970/1982).--.

COLUMN 3

Line 4, "layer" should read --toner layer--.

COLUMN 4

Line 48, "other" should read --outer--.

COLUMN 6

Line 16, "is" should read --as--.
Line 25, "the that of" should read --that of the--.

COLUMN 7

Line 35, "result of the" should read --the result of--.

COLUMN 8

Line 48, "αpXΔl (1)" should read --αpXΔl (1)--.
Line 62, "Friction force αpXΔvXt=pXΔvXd/vd." should read --Friction force αpXΔvXt=pXΔvXd/vd.--.

COLUMN 9

Line 41, "15-150 (g.cm)," should read --15-150 (g/cm),--.
Line 61, "the the" should read --the--.

UNITED STATES PATENT AND TRADEMARK OFFICE

CERTIFICATE OF CORRECTION

PATENT NO. : 4,739,370

DATED : April 19, 1988

INVENTOR(S) : NOBUTOSHI YOSHIDA, ET AL.

It is certified that error appears in the above-identified patent and that said Letters Patent is hereby corrected as shown below:

COLUMN 10

Line 51, "though" should read --through--.

COLUMN 11

Line 22, "μm" should read --mm--.
Line 58, "in" should be deleted.

COLUMN 12

Line 23, "Δv" should read --ΔV--.

Signed and Sealed this

Twenty-third Day of May, 1989

*Attest:*

*Attesting Officer*

DONALD J. QUIGG

*Commissioner of Patents and Trademarks*